US008912423B1

(12) United States Patent
Gotzmer et al.

(10) Patent No.: US 8,912,423 B1
(45) Date of Patent: Dec. 16, 2014

(54) EXTENSIBLE TORPEDO

(71) Applicants: Carl Gotzmer, Accokeek, MD (US); Steven Kim, Crofton, MD (US)

(72) Inventors: Carl Gotzmer, Accokeek, MD (US); Steven Kim, Crofton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 124 days.

(21) Appl. No.: 13/815,211

(22) Filed: Feb. 11, 2013

(51) Int. Cl.
*F42B 19/00* (2006.01)

(52) U.S. Cl.
CPC ..... *F42B 19/00* (2013.01)
USPC ..... 114/22

(58) Field of Classification Search
CPC ..... F42B 19/00
USPC ..... 102/399; 114/20.1, 22, 20.2, 23
See application file for complete search history.

(56) References Cited

U.S. PATENT DOCUMENTS

| | | | | |
|---|---|---|---|---|
| 1,049,144 | A | 12/1912 | Quisling | |
| 4,944,226 | A | 7/1990 | Wedertz et al. | |
| 5,522,337 | A | 6/1996 | Meyers et al. | |
| 5,686,694 | A | 11/1997 | Hillenbrand et al. | |
| 5,892,217 | A | 4/1999 | Pollin | |
| 6,492,632 | B1 | 12/2002 | Pollin | |
| 6,655,313 | B1 | 12/2003 | Woodall et al. | |
| 6,962,121 | B1 * | 11/2005 | Kuklinski | 114/67 A |
| 7,290,496 | B2 | 11/2007 | Asfar et al. | |
| 7,388,145 | B1 | 6/2008 | Olson et al. | |
| 8,250,981 | B1 * | 8/2012 | Gotzmer et al. | 102/314 |
| 8,387,535 | B1 * | 3/2013 | Guirguis et al. | 102/315 |

* cited by examiner

*Primary Examiner* — Reginald Tillman, Jr.
(74) *Attorney, Agent, or Firm* — Fredric J. Zimmerman

(57) ABSTRACT

An extensible torpedo has a body, a cavity within the body and a water reactive material in communication with the cavity. A mechanism selectively positions the cavity between a first volume and a second volume and also selectively positions the torpedo between a first length and a second length. The second volume and length are greater than the first volume and length. The mechanism introduces ambient water into the cavity in a volume that represents a stoichiometric balance with the amount of water reactive material.

18 Claims, 5 Drawing Sheets

EXTENSIBLE TORPEDO

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to an extensible torpedo.

2) Description of Prior Art

The ability to extend or telescope following deployment is known for projectiles including undersea vehicles and torpedoes. One known mechanism for extending an undersea vehicle or torpedo following launch is a slide mechanism. In a slide mechanism, a shaft member at the aft section of the projectile is slidably mounted on a boom extending from the body of the projectile. The shaft slides along the boom in a contained manner. The projectile is initially assembled with the shaft in the forward most position. The shaft is retained in the forward position until the projectile exits the launch tube. After exiting the launch tube, the shaft slides to a rear-flight position and is locked in this position during flight. The mechanism for extending the projectile to its flight length configuration utilizes the high-pressure gas from the burning propellant of the projectile. As an alternative, a separate solid propellant or compressed gas cylinder is provided in the projectile boom causing the shaft to slide to the flight position.

Some extensible projectiles create a cavity, or increase an existing cavity volume, upon extension. One example is an unmanned underwater vehicle having a first tail cone portion with an internal cavity and a second tail cone portion positionable in and axially extensible from the cavity. Prior to separation of the vehicle from a ram plate, the tail cone second portion is held against the first portion by that ram plate. After separation of the vehicle from the launch tube, a spring urges the tail cone second portion rearwardly to an extended position, lengthening the vehicle and increasing the volume of the internal cavity.

Other projectiles include a compartment within their bodies. A flexible bladder is contained within the compartment and may be extended or retracted using a variety of materials, including air or water. For example, inlets in the body are connected through a conduit to a pump. The pump draws ambient water from around the underwater vehicle through the inlet and conduit and into the flexible bladder, thereby extending it.

For explosive projectiles, reactive materials are often housed within the projectile; however, the mass of these materials often adversely affects projectile maneuverability. In explosive projectiles that use water as a reactive material, this mass is particularly burdensome. In addition, reactions that use water are slowed by an excess amount of water that cools the reaction. Slowing of the reaction decreases the effectiveness of the explosive projectile.

SUMMARY OF THE INVENTION

Exemplary embodiments of systems and methods in accordance with the present invention provide a mechanism to extend the length of the torpedo. In addition, mechanisms are provided to draw a pre-determined volume of water into the torpedo cavity. The water is used to react with an amount of water reactive material within the torpedo, and the pre-determined volume of water is stoichiometrically balanced with the amount of water reactive material.

In one exemplary embodiment, the mechanism to extend the length of the body utilizes a rod with helical threads that is attached to the tail section of the torpedo. A motor in communication with the rod, rotates and advances the rod into a threaded socket located in the nose section of the torpedo. The helical threads of the rod engage on the threaded socket and move the nose section relative to the tail section thereby lengthening the body. In this embodiment, one or more openings are exposed when the body lengthens. Water enters the cavity through these openings.

In another embodiment, the mechanism to extend the length of the body utilizes an explosive charge located in a pocket defined by a shaft in the nose section, into which a portion of the tail section extends. When an igniting mechanism in communication with the explosive charge is detonated, the nose section advances relative to the tail section and lengthens the body. In this embodiment, one or more openings are exposed when the body lengthens. Water enters the cavity through these openings.

In another embodiment, the mechanism to extend the length of the body utilizes an expandable bellows chamber attached to the tail section of the torpedo. An opening on the nose section is the entry point for water from the ambient environment. A pump within the nose section pumps water through the opening, through a conduit and into the expandable bellows chamber. As the bellows chamber fills with water, it expands, lengthening the body and increasing the cavity volume. Alternatively, one or more openings are located on the side of the body, and water is pumped in also using a pump and conduit system.

A water reactive material is disposed in the torpedo adjacent the cavity. The size of the cavity is chosen such that a stoichiometric balance is achieved between the amount of water and the amount of water reactive material. With a stoichiometric balance, all of the water contained in the cavity will react with all of the water reactive material. Since all of the material present in the cavity is involved in the reaction, there is no excess water to cool and slow the reaction. This situation results in a quicker, hotter and more efficient reaction. The water reactive material used is any material that reacts violently with water and produces gas and heat.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Exemplary embodiments in accordance with the present invention are directed to methods and systems that extend the length of underwater vehicles or underwater projectiles and that draw in water to fill a cavity located within the projectile. Suitable projectiles and underwater vehicles include, but are not limited to, unmanned undersea vehicles (UUVs), submarines and torpedoes. Embodiments as disclosed herein are discussed with respect to a torpedo embodiment. However, the various aspects and features of the present invention may be used with any suitable underwater vehicle or projectile. In one exemplary embodiment, the volume of the cavity increases at the same time as the length of the torpedo increases. Therefore the same mechanism draws in the water and extends the length of the torpedo simultaneously. In one exemplary embodiment, the mechanism extends the length of the torpedo, increases the size of the cavity and fills the cavity with water.

At least one water reactive material is provided in communication with the cavity. This water reactive material is selected to react violently when exposed to water to produce gas and heat. Suitable water reactive materials include, but are not limited to, an alkali metal, an alkali metal hydride, an alkali metal nitride, calcium carbide, phosphorus pentoxide, a non-metal halide, an inorganic acid halide, an anhydrous metal halide, an organic acid halide, an anhydride of a low molecular weight, a metal hydride, a non-metal hydride and combinations thereof. The water used to react with the reactive material is obtained from the ambient environment of the torpedo and includes saltwater, brackish water and fresh water. Alternatively, a separate source of water may be provided within the torpedo. When water is drawn into the torpedo, this water mixes with the water reactive material, initiating the reaction between the water and the reactive material. In one exemplary embodiment, the volume of the cavity is selected such that the volume of water drawn into the cavity represents a stoichiometric balance with the amount of water reactive material. As used herein, a stoichiometric balance between the volume of water contained in the cavity and the amount of water reactive material provides for complete reaction between the two components. Since all of the water in the cavity is involved in the reaction, there is no excess water to cool and slow the reaction. This situation results in a quicker, hotter and more efficient reaction.

Figure 1:
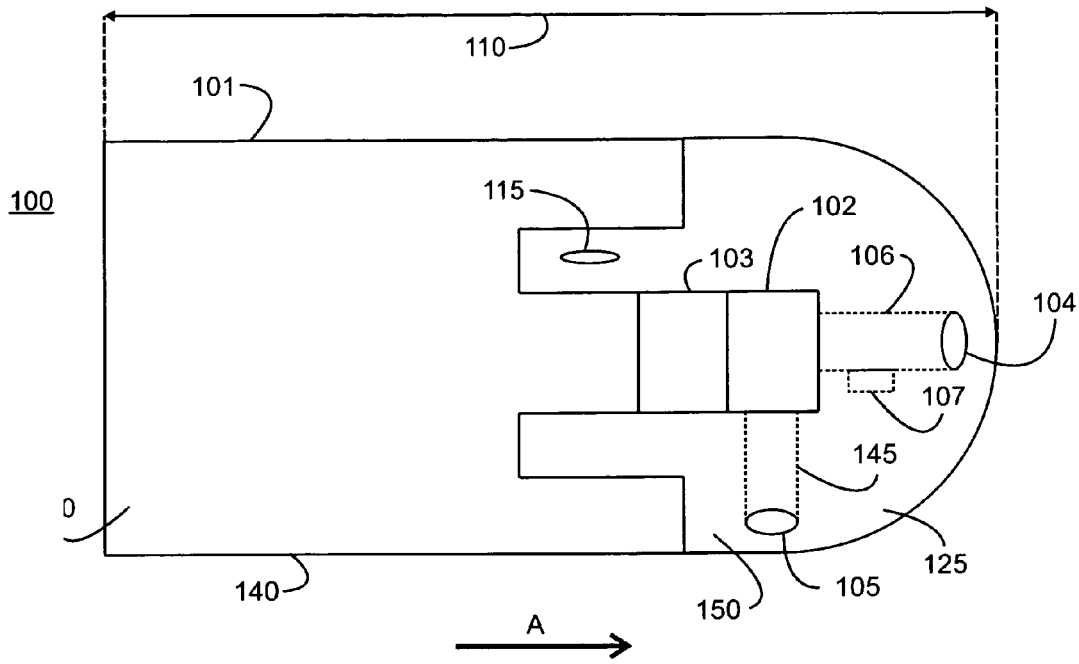
FIG. 1 is a schematic representation of an embodiment of an extendable torpedo in accordance with the present invention in an initial position.
Figure 2:
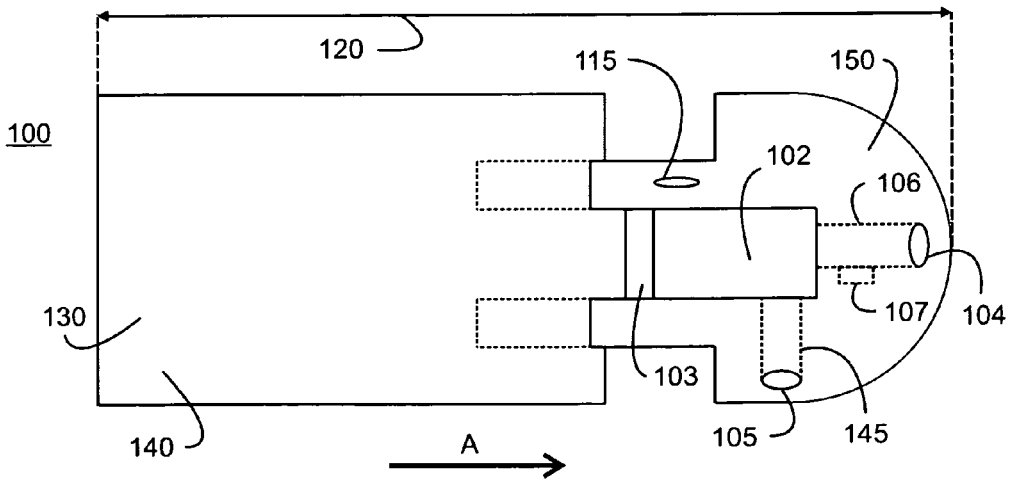
FIG. 2 is a schematic representation of the embodiment of the extendable torpedo of FIG. 1 in a second extended position.

Referring initially to FIGS. 1 and 2, an exemplary embodiment of an extensible torpedo 100 in accordance with the present invention is illustrated. In FIG. 1, the torpedo 100 is illustrated in a first or initial position having a first length 110. In FIG. 2, the torpedo is illustrated in a second or final position having a second length 120. The second length is longer than the first length. In one exemplary embodiment, the torpedo is positioned in its initial position during storage and prior to deployment, moving to the second position following deployment. The torpedo 100 includes a body 101.

A cavity 102 is disposed within the body. In one embodiment, the cavity starts as a closed cavity or a very small cavity. In FIG. 1, the cavity has a first volume. As illustrated, this first volume represents the volume of a closed cavity or very small cavity. In FIG. 2 the cavity has a second volume. The second volume is greater than the first. Therefore, the first or initial volume of the cavity, in addition to being a closed cavity, i.e., zero or negligible volume, may be any volume up to the second volume. As illustrated, the cavity 102 has the first volume when the extensible torpedo has the first length (initial position) and the second volume when the extensible torpedo has the second length (final position). The extensible torpedo may be moved between the first position and volume and the second position and volume.

The extensible torpedo also includes an amount of a water reactive material 103 in communication with the cavity. The amount of water reactive material does not change when the torpedo extends from the first length to the second length, however, the water reactive material is consumed in the reaction. Suitable water reactive materials include any material that reacts violently with water including the materials listed above. The water reactive material is located within the body of the torpedo so as to be selectively exposed to water. In one embodiment, the water reactive material is shielded from water exposure when the torpedo is in the final position. In an exemplary embodiment, the water reactive material is in communication with the cavity. In one exemplary embodiment, the water reactive material forms at least a portion of one wall of the cavity. In one exemplary embodiment, the cavity is cylindrical, and the water reactive material has a disc shape and is located at one end of the cavity. In another embodiment the water reactive material forms all of the walls of the cavity. In addition to there being a single amount or mass of water reactive material, the reactive material may be formed as a plurality of smaller pieces of water reactive material. In one exemplary embodiment, a plurality of separate and distinct water reactive materials are disposed within the cavity.

In order to introduce water into the cavity for reaction with the water reactive material, the extensible torpedo 100 includes one or more mechanisms to introduce water into the cavity. In an exemplary embodiment, the introduced volume of water is a predetermined volume of water based on the amount of water reactive material in the cavity. This predetermined volume of water may be stored within the extensible torpedo, and the mechanism may provide for mixture between the water and the water reactive material at the desired time. However, in an exemplary embodiment, the desired volume of water is obtained from the ambient environment of the torpedo, e.g., from seawater, and the mechanism controls entry of the water into the cavity. As shown in FIG. 1, the extensible torpedo includes a nose section 125 and a tail section 130 opposite the nose section, and the mechanism includes at least one opening 104 passing through the body of the torpedo and disposed in the nose section of the torpedo. The opening 104 faces a direction of travel of the torpedo as indicated by arrow A. In this embodiment, the mechanism also includes a channel or conduit 106 in fluid communication with the opening 104 and the cavity 102. Alternatively, the mechanism includes at least one opening 105 disposed along the body 101 of the torpedo between the nose section 125 and the tail section 130. This opening also passes through the body of the torpedo and faces a direction perpendicular to the direction of travel of the torpedo. In this exemplary embodiment, the mechanism also includes a channel or conduit 145 in fluid communication with the opening 105 and the cavity 103. In one exemplary embodiment, the mechanism includes openings on both the nose section of the torpedo and along the length of the torpedo body.

In one exemplary embodiment, the torpedo body 101 is formed from a plurality of portions. These portions are movable with respect to each other. This relative movement provides for the selective positioning of the extensible torpedo in either the first length or the second length, and the cavity in either the first volume or the second volume. In an exemplary embodiment, the body includes at least a first portion 140 and a second portion 150 movably engaged with the first portion. For example, the two portions may be interlocking and slidable with regard to each other along an axis parallel to the length and the direction of travel of the extensible torpedo. In one exemplary embodiment, the cavity is disposed between the first portion and the second portion. Therefore, at least one part of the walls of the cavity is fixed to the first portion and one part of the walls of the cavity is fixed to the second portion. In one exemplary embodiment, the mechanism for filing the cavity with water includes an opening 115 passing through either the first portion 140 or the section portion 150. As illustrated, the opening passes through the second portion. This opening is not exposed to the ambient environment of the torpedo when the torpedo is in the first position but becomes exposed to the ambient environment when the torpedo is in the second position. Once the opening 115 is exposed to the ambient environment, water may pass through the opening, which is in communication with the cavity 102, and into the cavity.

In one exemplary embodiment, the mechanism includes at least one pump 107 in communication with at least one of the openings and the conduits. The pump is configured to draw water in through the openings and to fill the cavity.

In order to move the first portion relative to the second portion and to extend the torpedo from the first length to the second length, the torpedo includes a mechanism to move the portions of the body relative to each other, i.e., an extending mechanism. Although this extending mechanism and the mechanism to introduce water into the cavity may be separate and independent mechanisms, in an exemplary embodiment, the extensible torpedo includes a single mechanism that extends the length of the torpedo body 101 and fills the cavity 102 with water. In one exemplary embodiment, filling the cavity with water extends the length of the torpedo body. In another embodiment, extending the length of the torpedo body fills the cavity with water.

FIG. 1 depicts the torpedo at a first length 110, and FIG. 2 depicts the torpedo at a second length 120. Again, the second length is greater, i.e. longer, than the first length. The cavity has the first volume when the body has the first length, and a second volume when the body has the second length. Methods and systems in accordance with exemplary embodiments of the present invention introduce water into the cavity and move the body from the first length to the second length simultaneously. Therefore, the cavity enlarges from the first volume to the second volume as the body length increases.

The mechanism, when introducing water into the cavity, introduces a predetermined volume of water based on the amount of water reactive material in communication with the cavity. In an exemplary embodiment, this predetermined volume of water is stoichiometrically balanced with the amount of water reactive material. In one exemplary embodiment, the predetermined volume of water is equivalent to the first volume of the cavity, Alternatively, the predetermined volume of water is greater than the first volume of the cavity but less than the second volume of the cavity. In an exemplary embodiment, the predetermined volume of water is equivalent to the second volume of the cavity. Therefore, by extending the torpedo to the second length and the cavity to the second volume, a stoichiometrically balanced amount of water is introduced into the cavity by filling the second volume of the cavity. The amount is water is then exposed to the water reactive material. Alternatively, by introducing the predetermined volume of water into the cavity for exposure to the water reactive material, the volume of the cavity is expanded to the second volume, and the length of the torpedo body is extended to the second length.

Figure 3:
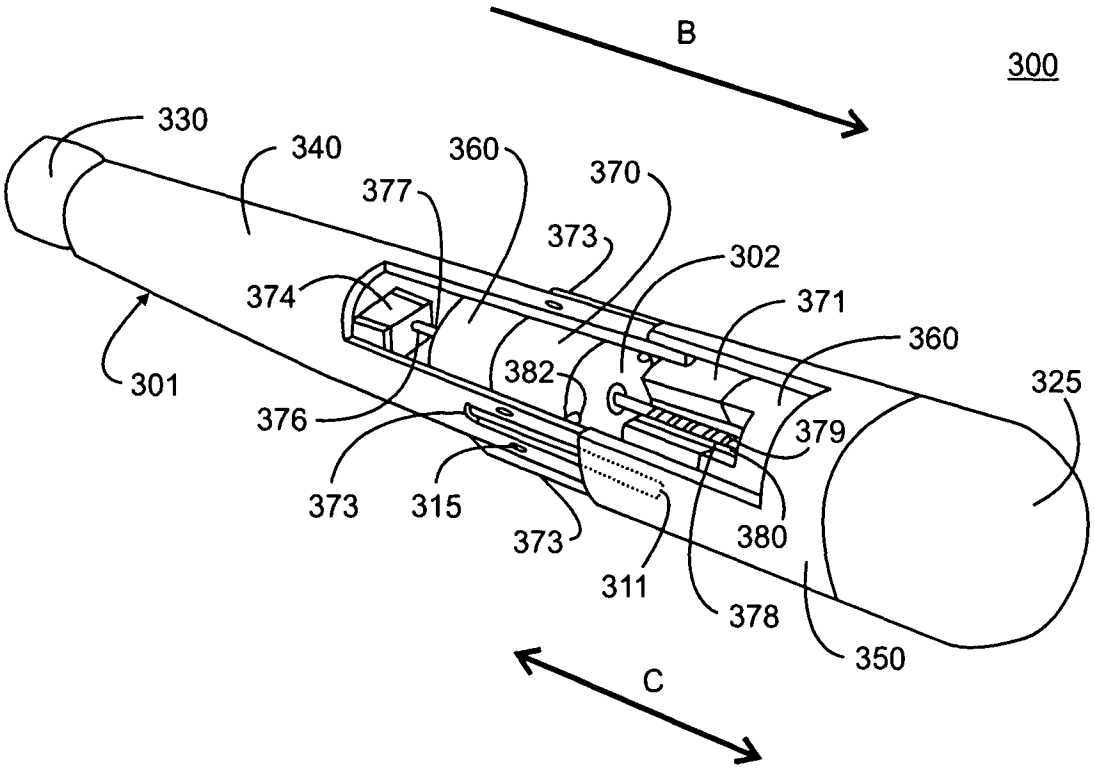
FIG. 3 is a representation of a perspective cut-away view of an embodiment of an extendable torpedo in accordance with the present invention.

Referring to FIG. 3, an exemplary embodiment of the extensible torpedo 300 in accordance with the present invention is illustrated. The torpedo includes a nose section 325 and a tail section 330 opposite the nose section 325. The torpedo 300 moves through the water in a direction of arrow B. The torpedo 300 includes a body 301 having a first portion 340 and a second portion 350 movably engaged with the first portion. In one exemplary embodiment, the tail section 330 is contained in the first portion 340, and the nose section 325 is contained in the second portion 350. The first and second portions are movably engaged with each other by being able to move with respect to each other in a direction as indicated by arrow C. In an exemplary embodiment, arrow C is parallel to arrow B. A plurality of ridges 373 extend along the exterior surface of the first portion parallel to the direction of arrow C. These ridges engage slots 311 running along interior surface of the second portion 350. Engagement of the ridges 373 in the slots guides movement of the first portion relative to the second portion in the direction of arrow C and inhibits rotational motion of the first section relative to the second section about an axis parallel to arrow C. In an exemplary embodiment, the ridges 373 may be substantially perpendicular/normal to a surface of the body 301.

The torpedo 300 also includes a cavity 302 as defined herein. The cavity is disposed within the body and generally cylindrical in shape, having a circular cross-section. Disposed within the body 301 in communication with the cavity 302 is at least one (first) water reactive material 370. The water reactive material is disc shaped and fits with the cavity. In an exemplary embodiment, a second water reactive material 371 is also disposed within the body in communication with the cavity. The second water reactive material 371 also has a complementary disc shape and may be the same material as the first water reactive material 370 or a different material. In one embodiment, the first and second water reactive materials 370, 371 are provided in an opposing arrangement at either end of the cavity. The torpedo also may include one or more main explosive charges 360 in communication with the water reactive materials 370, 371. Suitable main explosive charges include, but are not limited to, polymer bonded explosives (PBX). As illustrated, a separate main explosive charge is provided adjacent each water reactive material. Therefore, reaction of the water reactive materials ignites the main explosive charges 360 of the torpedo.

In this exemplary embodiment, the mechanism to extend the length of the torpedo includes at least one rotatable rod 377 in communication with the first and second portions 340, 350. The rod includes a first end 376 disposed within the first portion 340 and engaging a motor 374 that is fixed to the first portion 340. The rod 377 passes through a bearing sleeve 341 that passes through the main explosive charge and water reactive material. The rod continues through the cavity and includes a second end 378 opposite the first end 376 that is disposed in the second portion 350. Extending along the length of the rod from the second end are helical threads 379. These helical threads engage a threaded plate 380 or sleeve that is fixedly attached to the second portion 350. In one exemplary embodiment, the threaded plate passes axially through the water reactive material and the main explosive charge. Rotation of the rod by the motor, advances the helical threads through the threaded plate and moves the first portion of the body relative to the second portion of the body. This function changes a length of the extensible torpedo and the volume of the cavity as described herein.

The body also includes a plurality of openings 315 disposed radially around the first portion. In an exemplary embodiment, these openings 315 are covered by the second portion when the torpedo is at the first or initial length. In one exemplary embodiment, an opening is provided between adjacent pairs of ridges 373 on the first portion. When the torpedo moves to the second length, the openings are exposed. The openings are in communication with the cavity, and the cavity is expanding as the length is increasing. Therefore, water is drawn in through the openings 315 to fill the cavity, and the mechanism both extends the length of the torpedo and fills the cavity with the desired stoichiometrically balanced volume of water. In one exemplary embodiment, the openings 315 are disposed over one of the discs of water reactive material. In this exemplary embodiment, one or more conduits or channels 382 are provided in the water reactive material, running from the openings to the cavity to provide communication between the openings and the cavity.

Figure 4:
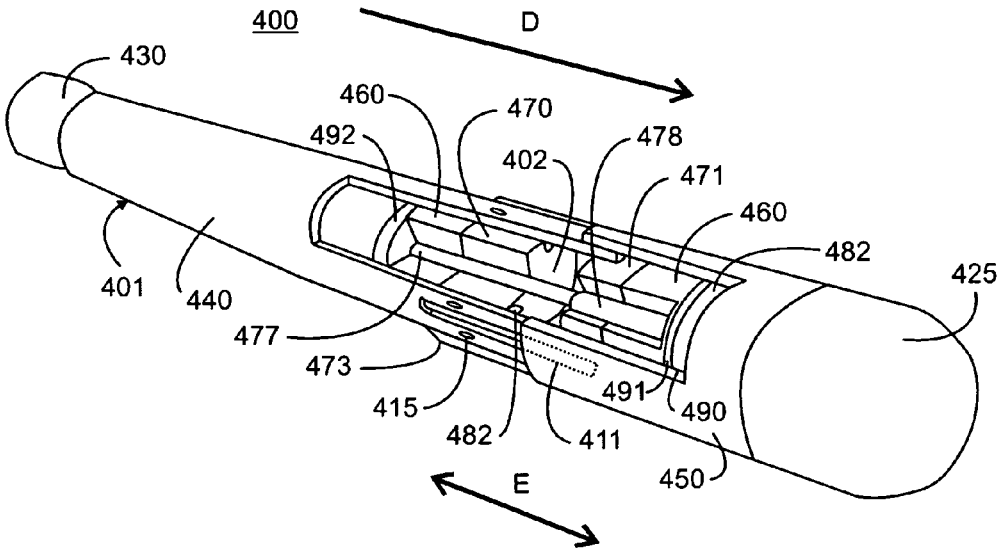
FIG. 4 is a representation of a perspective cut-away view of another embodiment of an extendable torpedo in accordance with the present invention.

Referring to FIG. 4, another exemplary embodiment of the extensible torpedo 400 in accordance with the present invention is illustrated. In this exemplary embodiment, the torpedo 400 includes a nose section 425 and a tail section 430 opposite the nose section 425 and moves through the water in the direction of arrow D. The torpedo 400 includes a body 401 having a first portion 440 and a second portion 450 movably engaged with the first portion. In one exemplary embodiment, the tail section 430 is contained in the first portion 440, and the nose section 425 is contained in the second portion 450. The first and second portions are movably engaged with each other by being able to move with respect to each other in a direction as indicated by arrow E. In an exemplary embodiment, arrow E is parallel to arrow D. A plurality of ridges 473 extend along the exterior surface of the first portion parallel to the direction of arrow E. These ridges engage slots 411 running along the interior surface of the second portion. Engagement of the ridges 473 in the slots guides movement of the first portion relative to the second portion in the direction of arrow E and inhibits rotational motion of the first section relative to the second section about an axis parallel to arrow E.

The torpedo 400 also includes a cavity 402 as defined herein. The cavity is generally cylindrical in shape. Disposed within the body in communication with the cavity is at least one water reactive material 470. The water reactive material is disc shaped and fits with the cavity. In an exemplary embodiment, a second water reactive material 471 is also disposed within the body in communication with the cavity. The second water reactive material also has a complementary disc shape and may be the same material as the first water reactive material or a different material. In one exemplary embodiment, the first and second water reactive materials 470, 471 are provided in an opposing arrangement at either end of the cavity. The torpedo may also include one or more main explosive charges 460 in communication with the water reactive materials. Suitable main explosive charges include, but are not limited to, PBX. As illustrated a separate main explosive charge is provided adjacent each water reactive material. Therefore reaction of the water reactive materials ignites the main explosive charges of the torpedo.

Figure 5:
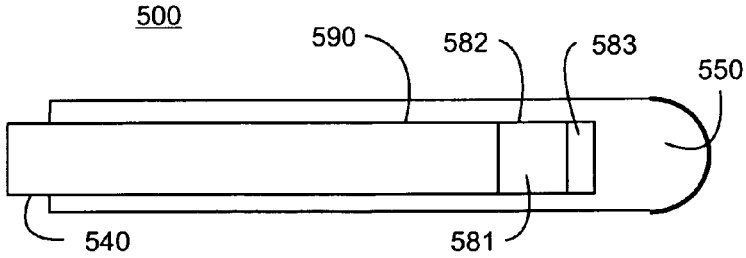
FIG. 5 is a schematic illustration of another embodiment of the extensible torpedo with an explosive charge extension mechanism in an initial position.
Figure 6:
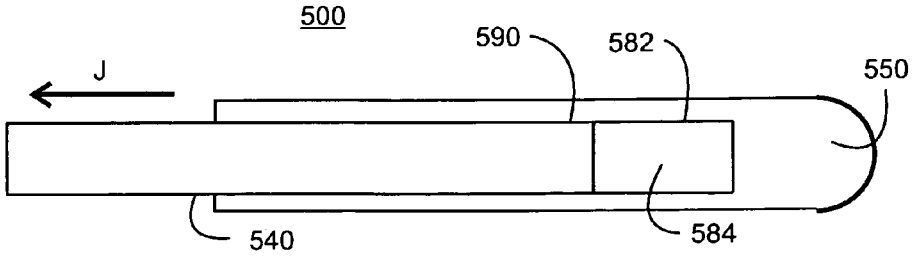
FIG. 6 is a schematic illustration of the embodiment of the extendable torpedo of FIG. 5 in a second extended position.

Referring to FIGS. 5 and 6, in this exemplary embodiment, the mechanism to extend the length of the torpedo 500 includes an explosive mechanism to drive the extensible torpedo from the first position as depicted in FIG. 5, to the second position as depicted in FIG. 6. The torpedo includes the first portion 540 and the second portion 550 movably engaged with the first portion. A shaft 590 extends into the second portion 550, and the first portion 540 extends at least partially into the shaft 590 to define a pocket 582 within the shaft. Although the shaft is illustrated in the second portion, the shaft 590 may be located in either portion of the torpedo. An explosive charge 581 is contained in the pocket 582, and an igniting mechanism 583 is also provided in the pocket 582 in communication with the explosive charge. When the explosive charge 581 is detonated by the igniting mechanism, the pocket 582 fills with expanding gas 584, driving the first portion 540 from the shaft in a direction opposite of arrow J, moving the extensible torpedo body from the first length to the second length.

Returning to FIG. 4, a pocket 482 is provided in the body to hold the explosive charge and igniting mechanism (not shown) of the length extending mechanism. The pocket 482 is formed by a first disk 491 that is slideably engaged in the shaft 490 of the second portion 450. The second water reactive material 471 and one of the main explosive charges 460 are fixedly disposed within the shaft such that the first disk 491 is located between the main explosive charge and the pocket. A rod 477 is fixedly attached to the first disk 491, and passes through a bearing collar 478 running axially through the second water reactive material 471 and one of the main explosive charges 460. The rod 477 passes axially through the first water reactive material 471 and one of the main explosive charges 460 and is fixedly attached at its opposite end to a second disk 492. The second disk is disposed in the first portion and fixedly attached thereto. Therefore, the distance between the first and second disks is fixed. An advance of the first disk through the cavity under the force of the gas produced by the explosive charge, advances the rod 477 through the bearing collar, i.e., the shaft, which the moves the first portion with respect to the second portion. This structure and function also moves the first and second water reactive materials with respect to each other and increases the volume of the cavity 402.

The body 401 also includes a plurality of openings 415 disposed radially around the first portion. In an exemplary embodiment, these openings are covered by the second portion when the torpedo is at the first or initial length. In one exemplary embodiment, an opening is provided between adjacent pairs of ridges on the first portion. When the torpedo moves to the second length, the openings are exposed. The openings are in communication with the cavity, and the cavity is expanding as the length is increasing. Therefore, water is drawn in through the openings to fill the cavity, and the mechanism both extends the length of the torpedo and fills the cavity with the desired stoichiometrically balanced volume of water. In one exemplary embodiment, the openings are disposed over one of the discs of water reactive material. In this exemplary embodiment, conduits or channels 482 are provided in the water reactive material, running from the openings to the cavity to provide communication between the openings and the cavity.

Figure 7:
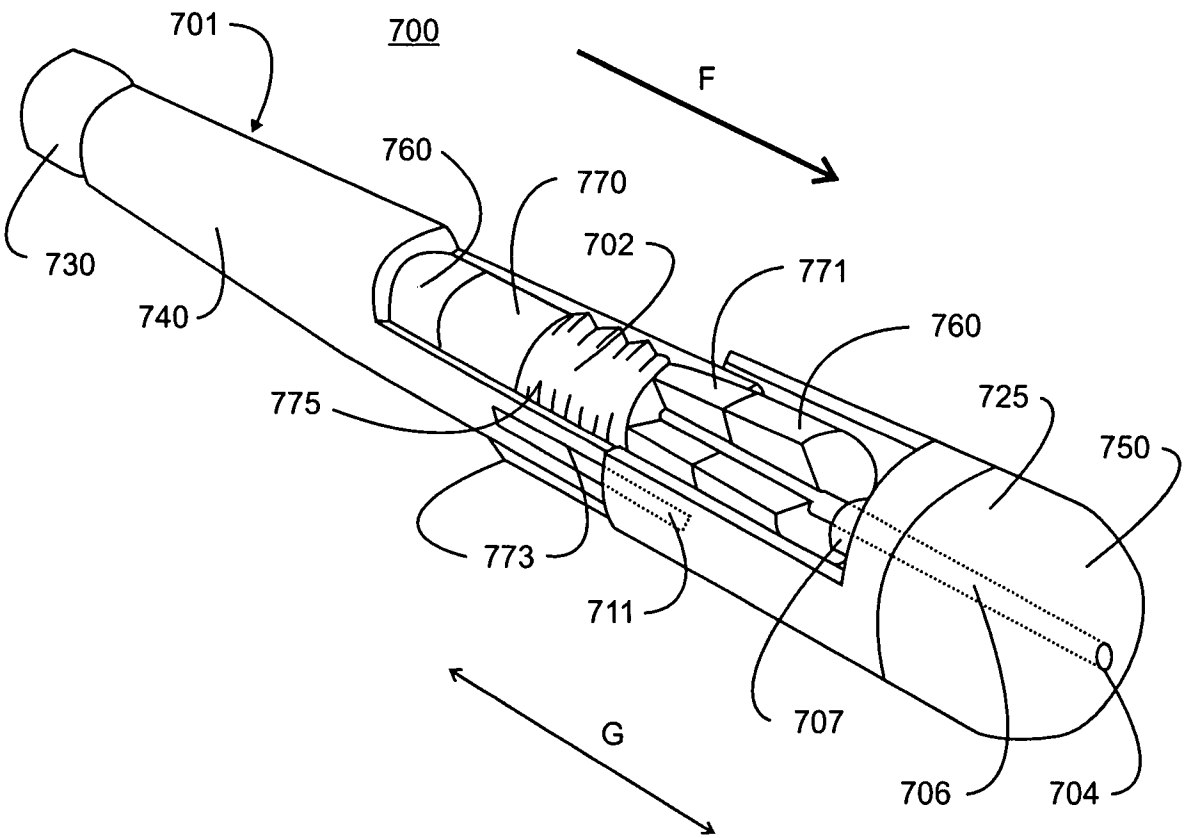
FIG. 7 is a representation of a perspective cut-away view of another embodiment of an extendable torpedo in accordance with the present invention.

Referring to FIG. 7, another exemplary embodiment of the extensible torpedo 700 in accordance with the present invention is illustrated. The torpedo includes a nose section 725 and a tail section 730 opposite the nose section 725. The torpedo 700 moves through the water in the direction of arrow F. The torpedo 700 includes a body 701 having a first portion 740 and a second portion 750 movably engaged with the first portion. In one exemplary embodiment, the tail section 730 is contained in the first portion, and the nose section 725 is contained in the second portion 750. The first and second portions are movably engaged with each other by being able to move with respect to each other in a direction as indicated by arrow G. In an exemplary embodiment, arrow G is parallel to arrow F. A plurality of ridges 773 extend along the exterior surface of the first portion parallel to the direction of arrow G. These ridges engage slots 711 running along the interior surface of the second portion. Engagement of the ridges in the slots guides movement of the first portion relative to the second portion in the direction of arrow G, and inhibits rotational motion of the first section relative to the second section about an axis parallel to arrow G.

The torpedo 700 also includes a cavity 702 as defined herein. The cavity is generally cylindrical in shape. Disposed within the body in communication with the cavity is at least one water reactive material 770. The water reactive material is disc shaped. In an exemplary embodiment, a second water reactive material 771 is also disposed within the body in communication with the cavity. The second water reactive material also has a complementary disc shape and may be the same material as the first water reactive material or a different material. In one exemplary embodiment, the first and second water reactive materials are provided in an opposing arrangement at either end of the cavity. The torpedo also may include one or more main explosive charges 760 in communication with the water reactive materials. Suitable main explosive charges include, but are not limited to, PBX. As illustrated, a separate main explosive charge is provided adjacent each water reactive material. Therefore reaction of the water reactive materials ignites the main explosive charges of the torpedo.

In this exemplary embodiment, the mechanism to extend the length of the torpedo includes at least one expandable bellows chamber 775 in communication with at least one of the first and second portions. The cavity 702 is disposed within the expandable bellows chamber. The expandable bellows chamber is attached to at least one portion of the torpedo. The expandable bellows chamber may be attached to the first portion 740, the second portion 750, or both portions. One or more openings 704 in the nose section of the torpedo are used to communicate water from the ambient environment into the torpedo. The extensible torpedo 700 includes at least one conduit 706 in fluid communication with the opening 704 and the cavity 702 within the expandable bellows chamber 775. The conduit axially passes through the second water reactive material 771 and one of the main explosive charges 760 disposed in the section portion 750. In one exemplary embodiment, a pump 707 is provided in communication with the conduit 706. The pump assists in directing water from the opening through the conduit and into the cavity.

In this exemplary embodiment, water from the ambient environment of the torpedo is pumped in through the opening using the pump 707. The water flows through the conduit 706 and into the expandable bellows chamber 775. As the cavity and the expandable bellows chamber fills with water, the chamber expands and moves the first portion 740 relative to the second portion 750. The cavity 702 also moves from the first volume to the second volume, and the body 701 length from the first length to the second length.

Figure 8:
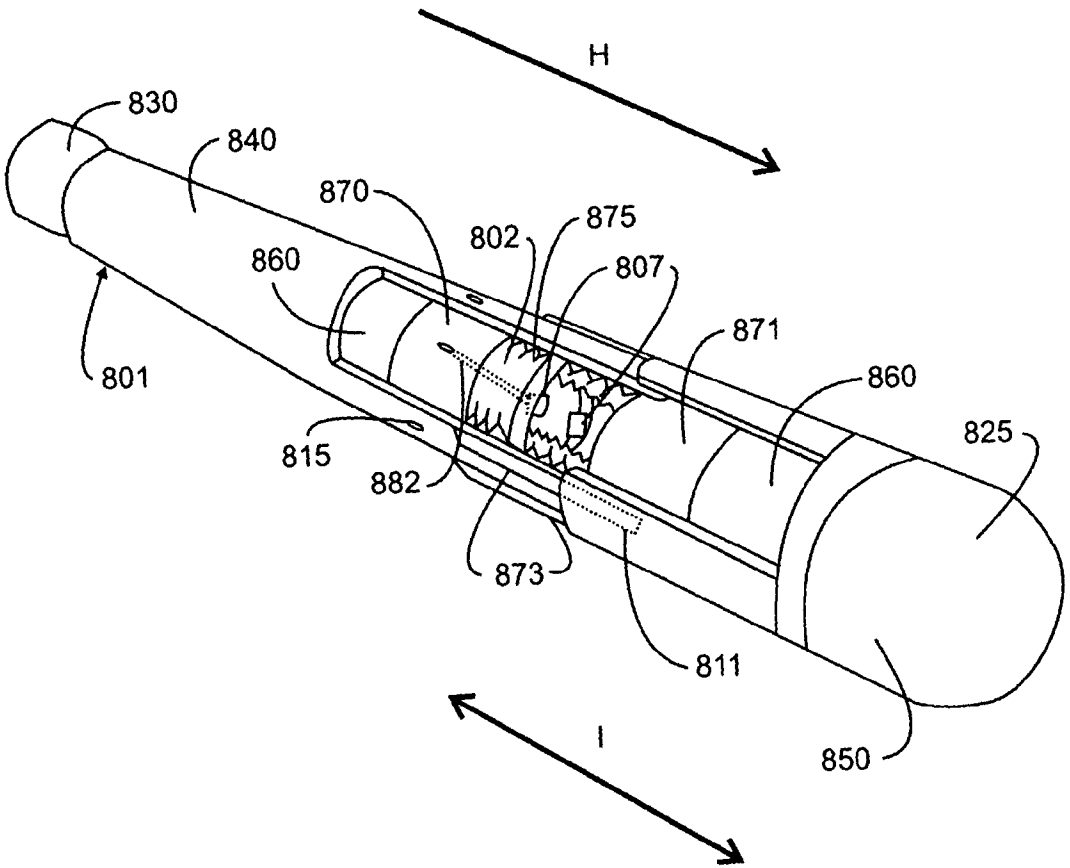
FIG. 8 is a representation of a perspective cut-away view of another embodiment of an extendable torpedo in accordance with the present invention.

Referring to FIG. 8, another exemplary embodiment of the extensible torpedo 800 in accordance with the present invention is illustrated. This embodiment is similar to the expandable bellows chamber embodiment of FIG. 7, but uses a plurality of radial disposed openings in the first portion in combination with a plurality of pumps disposed within the expandable bellows chamber to fill the cavity with water and to move the body from the first length to the second length. The torpedo 800 includes a nose section 825 and a tail section 830 opposite the nose section 825. The torpedo 800 moves through the water in the direction of arrow H. The torpedo 800 includes a body 801 having a first portion 840 and a second portion 850 movably engaged with the first portion. In one exemplary embodiment, the tail section 830 is contained in the first portion, and the nose section 825 is contained in the second portion 850. The first and second portions are movably engaged with each other by being able to move with respect to each other in a direction as indicated by arrow I. In an exemplary embodiment, arrow I is parallel to arrow H. A plurality of ridges 873 extend along the exterior surface of the first portion parallel to the direction of arrow I. These ridges engage slots 811 running along the interior surface of the second portion. Engagement of the ridges in the slots guides movement of the first portion relative to the second portion in the direction of arrow I and inhibits rotational motion of the first section relative to the second section about an axis parallel to arrow I.

The torpedo 800 also includes a cavity 802 as defined herein. The cavity is generally cylindrical in shape. Disposed within the body in communication with the cavity is at least one water reactive material 870. The water reactive material is disc shaped. In an exemplary embodiment, a second water reactive material 871 is also disposed within the body in communication with the cavity. The second water reactive material also has a complementary disc shape and may be the same material as the first water reactive material or a different material. In one exemplary embodiment, the first and second water reactive materials are provided in an opposing arrangement at either end of the cavity. The torpedo also may include one or more main explosive charges 860 in communication with the water reactive materials. Suitable main explosive charges include, but are not limited to, PBX. As illustrated a separate main explosive charge is provided adjacent each water reactive material. Therefore reaction of, the water reactive materials ignites the main explosive charges of the torpedo.

In this exemplary embodiment, the mechanism to extend the length of the torpedo includes at least one expandable bellows chamber 875 in communication with at least one of the first and second portions. The cavity 802 is disposed within the bellows chamber 875. The bellows chamber 875 in this embodiment is filled by water pumped from a plurality of openings 815 disposed radially around and passing through the first portion of the torpedo. The torpedo includes a plurality of conduits or channels 882. Each conduit is in fluid communication with one of the openings 815 and the cavity 802. A plurality of pumps 807 are provided within the bellows chamber in communication with the conduits. Therefore, the size of the interior of the bellows chamber is sufficient to accommodate a sufficient volume of the cavity to hold the desired stoichiometrically balanced amount of water and to account for the amount of space occupied by the pumps contained within the bellows chamber. The openings are not covered by the second portion when the torpedo is in the initial position. As water is drawn through the openings by the pumps and into the expandable bellows chamber, the bellows chamber fills with water, expanding and moving the first portion 840 relative to the second portion 850. In one exemplary embodiment, the cavity 802 also moves from the first volume to the second volume and the body 801 from the first length to the second length.

It will be understood that many additional changes in details, materials, steps, and arrangements of parts which have been described herein and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An extensible torpedo, comprising:

a body;

a cavity being disposed within the body;

an amount of a water reactive material being in communication with the cavity, wherein the water reactive material reacts violently with water to produce gas and heat; and a mechanism being in communication with the cavity and configured for introducing a volume of water into the cavity, wherein the introduced volume of water and the amount of water reactive material are stoichiometrically balanced to extend a length of the body.

2. The extensible torpedo of claim 1, wherein the mechanism configured to introduce a volume of water into the cavity comprises an opening through the body, and a conduit in communication with the opening and with the cavity.

3. The extensible torpedo of claim 2, wherein the body comprises a nose section and a tail section opposite the nose section, and wherein the opening is disposed in the nose section and faces a direction of travel of the torpedo.

4. The extensible torpedo of claim 2, wherein the body comprises a nose section and a tail section opposite the nose section, and wherein the opening is disposed along the body between the nose section and the tail section, and the opening faces perpendicular to a direction of travel of the torpedo.

5. The extensible torpedo of claim 2, wherein the mechanism further comprises a pump in communication with the conduit between the opening and the cavity.

6. The extensible torpedo of claim 1, wherein the mechanism is further configured to extend the length of the body from a first length to a second length, and wherein the second length is longer than the first length.

7. The extensible torpedo of claim 6, wherein the cavity comprises a first volume when the body comprises a first length and a second volume when the body comprises a second length, and wherein the cavity expands from the first volume to the second volume when the body extends from the first length to the second length.

8. The extensible torpedo of claim 6, wherein the mechanism is further configured to extend the body from the first length to the second length and to introduce the volume of water into the cavity simultaneously.

9. The extensible torpedo of claim 6, wherein the mechanism is further configured to extend a length of the body from a first length to a second length, wherein the second length is longer than the first length, wherein the body comprises a first portion, a second portion movably engaged with the first portion, wherein the mechanism further comprises a rod, which comprises a first end attached to the first portion, a second end opposite the first end, and helical threads extending along the rod from the second end, wherein the body further comprises a threaded socket attached to the second portion, the helical threads of the rod engaged in the threaded socket, wherein a motor is in communication with the rod and configured to rotate the rod, and wherein rotation of the rod by the motor advance the rod through the threaded socket and moves the first portion relative to the second portion.

10. The extensible torpedo of claim 6, wherein the mechanism is further configured to extend a length of the body from a first length to a second length, wherein the second length is longer than the first length, wherein the body comprises a first portion, and a second portion movably engaged with the first portion, wherein the second portion comprises a shaft, which extends into the second portion, wherein the first portion extends into the shaft, to define a pocket within the shaft between the first and second portions, wherein the mechanism further comprises an amount of an explosive charge disposed in the pocket, and an igniting mechanism in communication with the explosive charge, and wherein detonation of the explosive charge by the igniting mechanism advances the first portion through the shaft and moves the body from the first length to the second length.

11. The extensible torpedo of claim 6, wherein the mechanism is further configured to extend a length of the body from a first length to a second length, wherein the second length is longer than the first length, wherein the body comprises a first portion, and a second portion movably engaged with the first portion, wherein the mechanism further comprises an expandable bellows chamber in communication with the first and second portions, the cavity disposed within the expandable bellows chamber, an opening through the body, a conduit in communication with the opening and the expandable bellows chamber, and a pump in communication with the conduit, and wherein the pump is configured to transfer water from an ambient environment of the torpedo into the expandable bellows chamber, in order to expand the expandable bellows chamber and move the cavity from the first volume to the second volume and the body from the first length to the second length.

12. The extensible torpedo of claim 6, wherein the mechanism is further configured to extend a length of the body from a first length to a second length, wherein the second length is longer than the first length, wherein the body comprises a first portion, and a second portion movably engaged with the first portion, wherein the mechanism further comprises an expandable bellows chamber in communication with the first and second portions, the cavity disposed within the expandable bellows chamber, an opening through the body, a conduit in communication with the opening and the expandable bellows chamber, and a pump in communication with the conduit, wherein the pump is configured to transfer water from an ambient environment of the torpedo into the expandable bellows chamber, in order to expand the expandable bellows chamber and move the cavity from the first volume to the second volume and the body from the first length to the second length, and wherein the pump is disposed within the expandable bellows chamber.

13. The extensible torpedo of claim 1, wherein the water reactive material comprises at least one of an alkali metal, an alkali metal hydride, an alkali metal nitride, calcium carbide, phosphorus pentoxide, a non-metal halide, an inorganic acid halide, an anhydrous metal halide, an organic acid halide, an anhydride of a low molecular weight, a metal hydride, and a non-metal hydride.

14. An extensible torpedo, comprising:

a body comprising a first length, and a second length, wherein the second length is longer than the first length;

a cavity being disposed within the body, wherein the cavity comprises a first volume when the body comprises the first length, and a second volume when the body comprises the second length;

an amount of a water reactive material being in communication with the cavity, wherein the water reactive material reacts violently with water to produce gas and heat; and a mechanism being in communication with the cavity and configured to introduce a volume of water into the cavity equal to the second volume and to extend the body from the first length to the second length simultaneously, wherein the introduced volume of water and the amount of water reactive material are stoichiometrically balanced.

15. The extensible torpedo of claim 14, wherein the mechanism comprises an opening through the body, and a conduit in communication with the opening and with the cavity.

16. The extensible torpedo of claim 15, wherein the body comprises a nose section, and a tail section opposite the nose section, and wherein the opening is disposed in the nose section and faces a direction of travel of the torpedo.

17. The extensible torpedo of claim 15, wherein the body comprises a nose section, and a tail section opposite the nose section, wherein the opening is disposed along a length of the body between the nose section and the tail section, and wherein the opening faces perpendicular to a direction of travel of the torpedo.

18. The extensible torpedo of claim 15, wherein the mechanism further comprises a pump in communication with the conduit between the opening and the cavity.

* * * * *